US011946170B2

(12) United States Patent
Lee

(10) Patent No.: US 11,946,170 B2
(45) Date of Patent: Apr. 2, 2024

(54) DEODORANT AND ANTIBACTERIAL PROTECTIVE CLOTH AND MANUFACTURING METHOD THEREOF

(71) Applicant: QUANN CHENG INTERNATIONAL CO., LTD., Pingtung (TW)

(72) Inventor: Hsing-Hsun Lee, Kaohsiung (TW)

(73) Assignee: QUANN CHENG INTERNATIONAL CO., LTD., Pingtung (TW)

( * ) Notice: Subject to any disclaimer, the term of this patent is extended or adjusted under 35 U.S.C. 154(b) by 330 days.

(21) Appl. No.: 17/477,511

(22) Filed: Sep. 16, 2021

(65) Prior Publication Data

US 2023/0051948 A1 Feb. 16, 2023

(30) Foreign Application Priority Data

Aug. 10, 2021 (TW) ..... 110129501

(51) Int. Cl.

| | |
|---|---|
| ***D02G 3/04*** | (2006.01) |
| ***D01F 8/06*** | (2006.01) |
| ***D01F 8/08*** | (2006.01) |
| ***D01F 8/12*** | (2006.01) |
| ***D01F 8/14*** | (2006.01) |

(Continued)

(52) U.S. Cl.

CPC ..... *D02G 3/04* (2013.01); *D01F 8/06* (2013.01); *D01F 8/08* (2013.01); *D01F 8/12* (2013.01); *D01F 8/14* (2013.01); *D01F 8/16* (2013.01); *D01F 11/04* (2013.01); *D02J 1/228* (2013.01); *D02J 3/18* (2013.01); *D10B 2331/10* (2013.01);

(Continued)

(58) Field of Classification Search

CPC ..... D02G 3/04; D02G 3/449; D01F 1/103; D01F 11/04; D01F 8/06; D01F 8/08; D01F 8/12; D01F 8/14; D01F 8/16; D02J 1/22; D02J 1/228; D02J 13/006; D02J 3/18; D10B 2331/10; D10B 2401/041; D10B 2401/13; D10B 2401/04; B29C 65/4815; B29C 66/71; B29C 66/712; B29C 66/7212

USPC ..... 156/60, 150, 151, 229, 283, 296, 308.2, 156/309.6, 314, 319, 331.7; 428/357, 428/364, 372, 373

See application file for complete search history.

(56) References Cited

U.S. PATENT DOCUMENTS 6,479,144 B2 * 11/2002 Petrea ..... C08L 75/04 428/293.4

6,593,255 B1 * 7/2003 Lawton ..... C03C 25/42 442/187

(Continued)

*Primary Examiner* — Philip C Tucker
*Assistant Examiner* — Brian R Slawski
(74) *Attorney, Agent, or Firm* — Leong C. Lei

(57) ABSTRACT

A method for manufacturing a deodorant and antibacterial protective cloth includes: providing a first fiber thread and a second fiber thread, where the first fiber thread is a core-spun yarn formed by a blended slurry, a nano metal solution, a plurality of inorganic particles, and a plurality of thermoplastic polyurethane colloidal particles, the thermoplastic polyurethane colloidal particles are hot melted and then wrapped around a peripheral side of a core thread of the core-spun yarn for isolation from an outer wrapping layer of the core-spun yarn, and the second fiber thread is the same as the first fiber thread or is a single-thread yarn formed by the blended slurry and the nano metal solution; and intersecting and laminating the first fiber thread and the second fiber thread to form a plurality of bonding layers.

15 Claims, 6 Drawing Sheets

(51) Int. Cl.

| | |
|---|---|
| ***D01F 8/16*** | (2006.01) |
| ***D01F 11/04*** | (2006.01) |
| ***D02J 1/22*** | (2006.01) |
| ***D02J 3/18*** | (2006.01) |

(52) U.S. Cl.
CPC .... *D10B 2401/041* (2013.01); *D10B 2401/13* (2013.01); *D10B 2501/04* (2013.01)

(56) References Cited

U.S. PATENT DOCUMENTS

| | | | | |
|---|---|---|---|---|
| 2008/0308775 | A1* | 12/2008 | Yabuki | D01F 6/62 252/587 |
| 2009/0269379 | A1* | 10/2009 | Herbst | A01N 31/16 36/43 |
| 2010/0263109 | A1* | 10/2010 | Noerenberg | D06M 11/83 156/60 |
| 2021/0172092 | A1* | 6/2021 | Park | D06M 15/564 |

* cited by examiner

DEODORANT AND ANTIBACTERIAL PROTECTIVE CLOTH AND MANUFACTURING METHOD THEREOF

CROSS-REFERENCE TO RELATED APPLICATION

This application claims the benefit of Taiwan Patent Application No. 110129501, filed on Aug. 10, 2021, which is hereby incorporated by reference for all purposes as if fully set forth herein.

BACKGROUND

Technical Field

This application relates to the technical field of protective cloths, and specifically, to a deodorant and antibacterial high strength protective cloth and a manufacturing method thereof.

Related Art

Textiles in daily life are usually in contact with bodies of users. With the improvement of the standard of living and the rise of awareness of health of people, functional textiles with antibacterial, antifungus, or deodorant effects are increasingly popular in the market. Generally, fiber products using a deodorant or antibacterial fiber need to have laundering durability. In addition, for wide application, the deodorant fiber is further required to be dyed like a common fiber product. In a conventional process, an organic antibacterial agent is usually applied to a surface of a fiber. However, some organic antibacterial agents may have problems such as production of toxic substances, poor heat resistance, easy decomposition, easy volatilization, or possible microbial resistance.

In addition, an existing copper-ion fiber in the market usually exists using terylene or nylon as a carrier, which is obtained by blending near-nano-scaled copper powder or copper compounds into a fiber, that is, merely by adding copper powder into the fiber. By blending, not only a copper content of the fiber does not exceed 1%, but also the copper content may decrease with time. Since the copper-ion fiber exists using terylene or nylon as a carrier, hydrophilicity thereof is generally poor, and a fiber moisture regain rate is the same as that of the original fiber. Fabrics made of the copper ion fiber in the market require addition of more than 0-50% of the copper ion fiber to achieve antibacterial and deodorant effects. Not only antibacterial and deodorant effects and costs are undesirable, but also a protection formed thereby cannot realize more desirable antibacterial and deodorant effects.

Therefore, this specification provides a deodorant and antibacterial high strength protective cloth and a manufacturing method thereof.

SUMMARY

In view of the disadvantages of the related art, this application discloses a deodorant and antibacterial protective cloth and a manufacturing method thereof, to obtain a deodorant and antibacterial high strength protective cloth.

This application is achieved through the following technical solution:

In order to achieve the above objective, this application provides a method for manufacturing a deodorant and antibacterial protective cloth. The method comprises the following steps:

providing a first fiber thread and a second fiber thread, wherein the first fiber thread is a core-spun yarn formed by a blended slurry, a nano metal solution, a plurality of inorganic particles, and a plurality of thermoplastic polyurethane colloidal particles, the thermoplastic polyurethane colloidal particles are hot melted and then wrapped around a peripheral side of a core thread of the core-spun yarn for isolation from an outer wrapping layer of the core-spun yarn, and the second fiber thread is the same as the first fiber thread or is a single-thread yarn formed by the blended slurry and the nano metal solution; and intersecting and laminating the first fiber thread and the second fiber thread to form a plurality of bonding layers, wherein bonding arrangement angles in the layers comprise at least one of the following:

arrangement angles of the first fiber thread in a first layer, a third layer, and a fifth layer being successively 0°, 225°, and 135°, and arrangement angles of the second fiber thread in a second layer, a fourth layer, and a sixth layer being successively 90°, 315°, and 225°;

arrangement angles of the first fiber thread in the first layer, the third layer, and the fifth layer being successively 0°, 210°, and 150°, and arrangement angles of the second fiber thread in the second layer, the fourth layer, and the sixth layer being successively 90°, 300°, and 240°; and arrangement angles of the first fiber thread in the first layer, the third layer, and the fifth layer being successively 0°, 240°, and 120°, and arrangement angles of the second fiber thread in the second layer, the fourth layer, and the sixth layer being successively 90°, 330°, and 210°.

A method for forming the core-spun yarn comprises the following steps:

(A): mixing and stirring the blended slurry, the nano metal solution, the inorganic particles, and the thermoplastic polyurethane colloidal particles to form a mixed material, wherein the nano metal solution comprises first metal ions and comes into contact with the blended slurry to form a first metal ion fiber comprising the first metal ions;

(B): bringing a second metal into contact with the first metal ion fiber, so that the first metal ions undergo a reduction reaction to obtain a nano copper fiber yarn, wherein the nano copper fiber yarn comprises first metal nanoparticles obtained by means of the reduction of the first metal ions;

(C): drying the mixed material to remove moisture, and performing hot-melt spinning on the mixed material in a spinning machine, to obtain yarns from an outlet of the spinning machine to form the core thread, wherein the thermoplastic polyurethane colloidal particles are hot melted and then wrapped around the peripheral side of the core thread obtained from the outlet to form a first-stage thread;

(D): shaping a surface of the first-stage thread by performing first cooling on the first-stage thread;

(E): extending the cooled first-stage thread by using a tensile device;

(F): repeating step (A) and step (B) on the first-stage thread, and wrapping the mixed material around a periphery of the first-stage thread;

(G): shaping an inside of the first-stage thread by performing second cooling on the first-stage thread, to form a second-stage thread; and (H): collecting the second-stage thread to form a deodorant and antibacterial nano copper fiber yarn, wherein the deodorant and antibacterial nano copper fiber yarn is the first fiber thread or the first fiber thread and the second fiber thread.

A method for forming the single-thread yarn comprises the following steps:

(A): mixing and stirring the blended slurry and the nano metal solution to form a mixed material, wherein the nano metal solution comprises first metal ions and comes into contact with the blended slurry to form a first metal ion fiber comprising the first metal ions;

(B): bringing a second metal into contact with the first metal ion fiber, so that the first metal ions undergo a reduction reaction to obtain a nano copper fiber yarn, wherein the nano copper fiber yarn comprises first metal nanoparticles obtained by means of the reduction of the first metal ions;

(C): drying the mixed material to remove moisture, and performing hot-melt spinning on the mixed material in a spinning machine, to obtain yarns from an outlet of the spinning machine to form the single-thread yarn;

(D): shaping the single-thread yarn by performing cooling on the single-thread yarn; and (E): collecting the single-thread yarn, wherein the single-thread yarn is the second fiber thread.

The blended slurry comprises a first fiber yarn slurry and a second fiber yarn slurry, the first fiber yarn slurry is selected from a cotton fiber, a polyester fiber, a viscose fiber and a Modal fiber, an ultra-high-molecular-weight polyethylene fiber, and a polypropylene fiber, and the second fiber yarn slurry is selected from an aromatic polyamide fiber, a polyamide fiber, a polyethylene terephthalate fiber, a polyethylene naphthalate fiber, an extended-chain polyvinyl alcohol fiber, an extended-chain polyacrylonitrile fiber, a polybenzoxazole fiber, a polybenzothiazole fiber, a liquid-crystal copolyester fiber, a rigid-rod fiber, a glass fiber, and a structural glass fiber.

The thermoplastic polyurethane colloidal particles comprise thermoplastic polyurethane, polyethylene, polypropylene, polyethylene terephthalate, polyamide, polybutylene terephthalate, an ethylene-vinyl acetate copolymer or nylon, and copper modified polyacrylonitrile.

The plurality of inorganic particles is rare earth or mineral particle powder.

The first metal ions are copper ions, and the second metal comprises magnesium, aluminum, manganese, titanium, zinc, iron, nickel, tin, copper, or silver.

A standard reduction potential of the first metal ions is greater than a standard reduction potential of the second metal in an ionic state, and a standard reduction potential difference of the first metal ions is 0.4-4 volts greater than a standard reduction potential difference of the second metal in the ionic state.

A temperature for drying in step C is controlled between 100° C. and 150° C.

The first cooling in step D means that the first-stage thread continuously passes through a cooling tank over a period of time, and the second cooling in step G is natural air cooling.

The cooling in step D means that the single-thread yarn continuously passes through a cooling tank over a period of time.

In step E, the tensile device comprises a plurality of roller sets arranged in sequence to stretch the first-stage thread.

This application further aims to provide a deodorant and antibacterial protective cloth, manufactured by using the method for manufacturing a deodorant and antibacterial protective cloth.

This application has the following beneficial effects:

A nanoscale fiber thread may be obtained by simply performing the process of this application at a room temperature without requiring expensive environment control devices. Therefore, this application has low costs, and can reduce energy consumption and high thermal pollution. The obtained first fiber thread and second fiber thread are intersected and laminated to form a plurality of bonding layers, so as to form the deodorant and antibacterial protective cloth. By means of the laminated arrangement, flexibility of an original fiber thread is maintained, the protective cloth has a very high strength, which is unlikely to be pierced, so that a protection factor is increased, and the laminated arrangement enables desirable breathability for the protective cloth, so that the protective cloth has a deodorant effect. Since the protective cloth is made of the fiber threads, and the fiber threads have strong antibacterial properties, the protective cloth also has a desirable antibacterial effect.

BRIEF DESCRIPTION OF THE DRAWINGS

To describe the technical solutions of embodiments of this application or the related art more clearly, the following briefly introduces the accompanying drawings required for describing the embodiments or the related art. Apparently, the accompanying drawings in the following description show only some embodiments of this application, and a person of ordinary skill in the art may still derive other drawings from these accompanying drawings without creative efforts.

DETAILED DESCRIPTION

In order to make objectives, technical solutions, and advantages of embodiments of this application more clearly, the technical solutions in the embodiments of this application will be clearly and completely described in the following with reference to the accompanying drawings. It is obvious that the embodiments to be described are only some rather than all of the embodiments of this application. All other embodiments obtained by a person of ordinary skill in the art based on the embodiments of this application without making creative efforts shall fall within the protection scope of this application.

Figure 1:
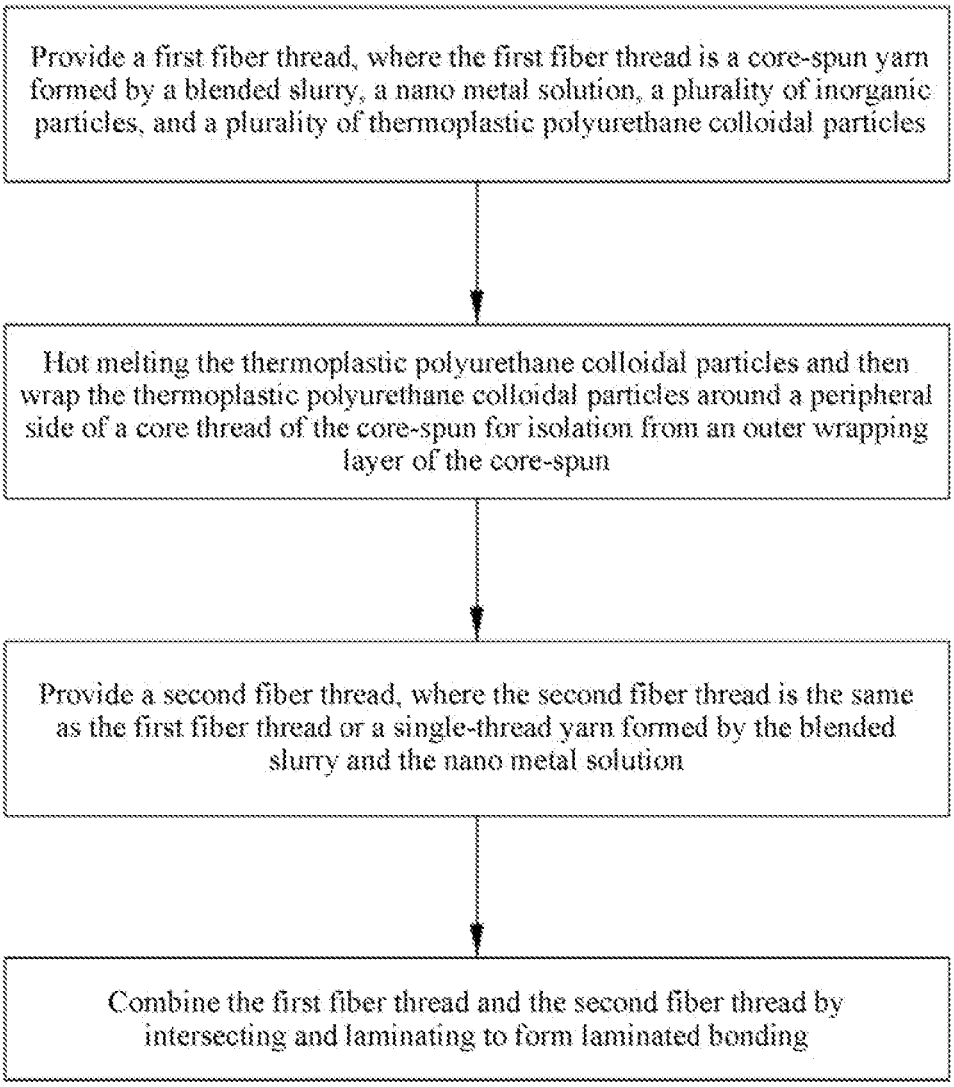
FIG. 1 is a flowchart of steps of a method for manufacturing a deodorant and antibacterial protective cloth according to an embodiment of this application.

FIG. 1 shows a flowchart of steps of a method for manufacturing a deodorant and antibacterial protective cloth according to this application. The method includes: providing a first fiber thread and a second fiber thread, where the first fiber thread is a core-spun yarn formed by a blended slurry, a nano metal solution, a plurality of inorganic particles, and a plurality of thermoplastic polyurethane colloidal particles, the thermoplastic polyurethane colloidal particles are hot melted and then wrapped around a peripheral side of a core thread of the core-spun yarn for isolation from an outer wrapping layer of the core-spun yarn, and the second fiber thread is the same as the first fiber thread or is a single-thread yarn formed by the blended slurry and the nano metal solution.

Figure 2:
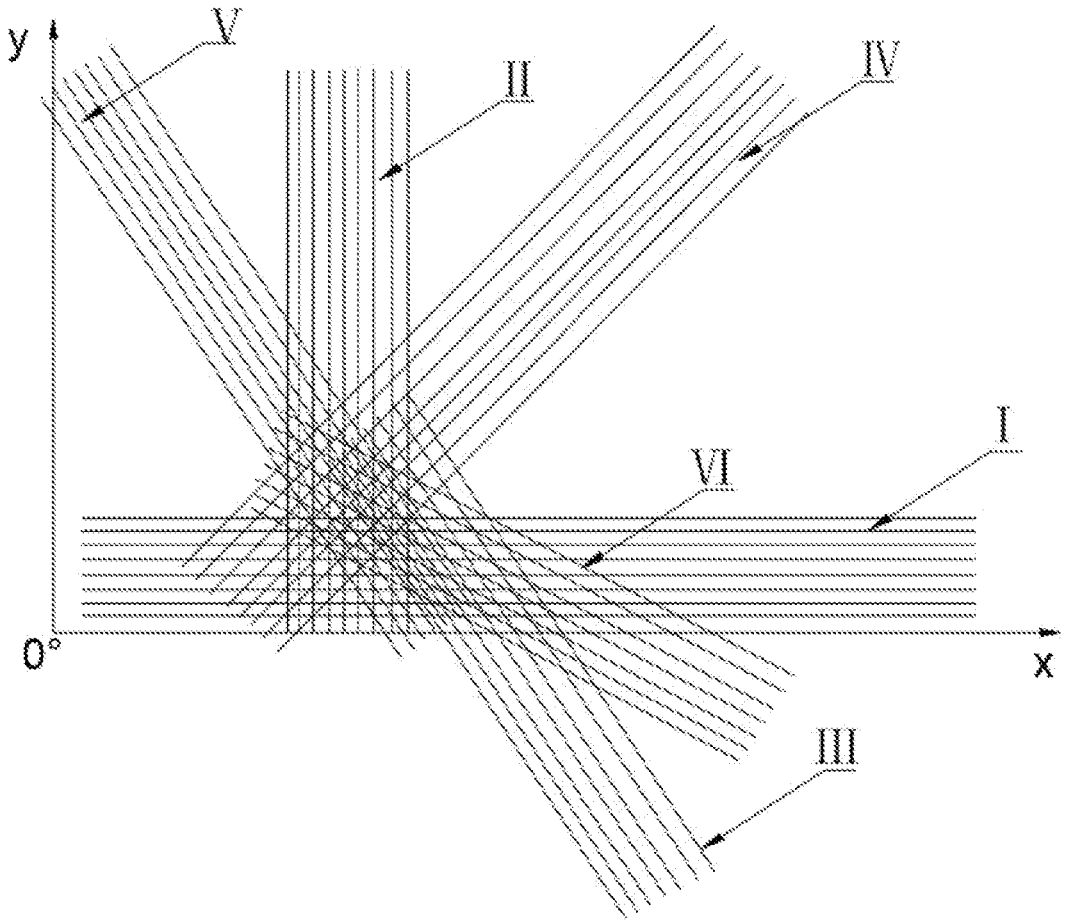
FIG. 2 is a diagram showing a plurality of bonding layers formed by intersecting and laminating a first fiber thread and a second fiber thread according to an embodiment of this application.

FIG. 2 shows a plurality of bonding layers formed by intersecting and laminating the first fiber thread and the second fiber thread.

In an embodiment, bonding arrangement angles in the layers are as follows: arrangement angles of the first fiber thread in a first layer I, a third layer III, and a fifth layer V are successively 0°, 225°, and 135°, and arrangement angles of the second fiber thread in a second layer II, a fourth layer IV, and a sixth layer VI are successively 90°, 315°, and 225°.

In an embodiment, bonding arrangement angles in the layers are as follows: arrangement angles of the first fiber thread in the first layer I, the third layer III, and the fifth layer V are successively 0°, 210°, and 150°, and arrangement angles of the second fiber thread in the second layer II, the fourth layer IV, and the sixth layer VI are successively 90°, 300°, and 240°.

In an embodiment, bonding arrangement angles in the layers are as follows: arrangement angles of the first fiber thread in the first layer I, the third layer III, and the fifth layer V are successively 0°, 240°, and 120°, and arrangement angles of the second fiber thread in the second layer II, the fourth layer IV, and the sixth layer VI are successively 90°, 330°, and 210°.

In an embodiment, the blended slurry includes a first fiber yarn slurry and a second fiber yarn slurry, the first fiber yarn slurry is selected from a cotton fiber, a polyester fiber, a viscose fiber and a Modal fiber, an ultra-high-molecular-weight polyethylene fiber, and a polypropylene fiber.

In an embodiment, the second fiber yarn slurry is selected from an aromatic polyamide fiber, a polyamide fiber, a polyethylene terephthalate fiber, a polyethylene naphthalate fiber, an extended-chain polyvinyl alcohol fiber, an extended-chain polyacrylonitrile fiber, a polybenzoxazole (PBO) fiber, a polybenzothiazole (PBT) fiber, a a liquid-crystal copolyester fiber, a rigid-rod fiber, a glass fiber, and a structural glass fiber.

In an embodiment, the aromatic polyamide fiber is preferably a p-aromatic polyamide fiber, and the rigid-rod fiber is preferably an M5® fiber.

In an embodiment, the glass fiber includes an electrical glass fiber, which uses E-glass, such as low alkali metal borosilicate glass having a desirable electrical property.

In an embodiment, the structural glass fiber uses S-glass, such as high-strength magnesium oxide-alumina-silicate glass.

In an embodiment, each one of the foregoing fiber types is generally known in the art. A copolymer, a block copolymer, and a blend of the foregoing materials are also applicable to manufacture of a group consisting of polymeric fibers.

In an embodiment, the thermoplastic polyurethane colloidal particles include thermoplastic polyurethane, polyethylene, polypropylene, polyethylene terephthalate, polyamide, polybutylene terephthalate, an ethylene-vinyl acetate copolymer or nylon, and copper modified polyacrylonitrile.

In an embodiment, the plurality of inorganic particles is rare earth or mineral particle powder.

In an embodiment, the first metal ions are copper ions, and the second metal includes magnesium, aluminum, manganese, titanium, zinc, iron, nickel, tin, copper, or silver.

Figure 5:
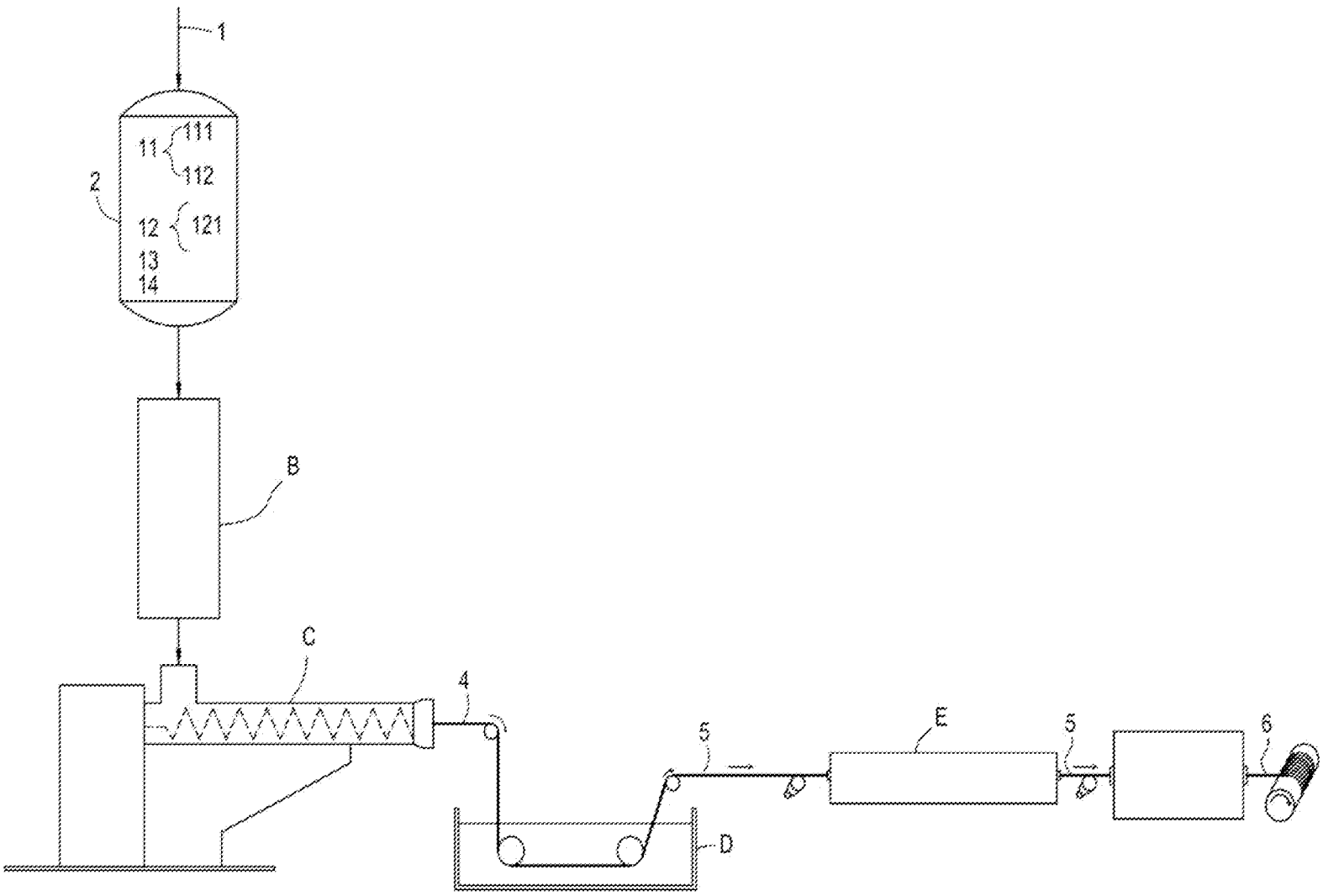
FIG. 5 is a diagram of a device system corresponding to a method for manufacturing a deodorant and antibacterial nano copper fiber yarn according to an embodiment of this application.

As shown in FIG. 5, a device system corresponding to a method for manufacturing a deodorant and antibacterial nano copper fiber yarn in this embodiment provides a raw material 1. The raw material 1 includes a blended slurry 11, a nano metal solution 12, a plurality of inorganic particles 13, and a plurality of thermoplastic polyurethane colloidal particles 14. The blended slurry 11 includes a first fiber yarn slurry 111 and a second fiber yarn slurry 112. The nano metal solution 12 includes first metal ions 121.

Further, the raw material 1 is mixed and stirred in a mixing tank 11 to form a mixed material 2, so that the nano metal solution 12 comes into contact with the blended slurry 11 to form a first metal ion fiber 21 including the first metal ions.

Further, a second metal 3 is brought into contact with the first metal ion fiber 21, so that the first metal ions undergo a reduction reaction. Thus, the first metal ion fiber 21 obtains electrons so as to obtain the nano copper fiber yarn. The nano copper fiber yarn includes first metal nanoparticles obtained by means of the reduction of the first metal ions.

In an embodiment, the second metal may include magnesium, aluminum, manganese, titanium, zinc, iron, nickel, tin, copper, or silver.

Further, the mixed material 2 is dried to remove moisture. The drying operation may be performed in an oven B, and a temperature in the oven B may be controlled between 100° C. and 150° C. However, the temperature control is not limited thereto.

Figure 6:
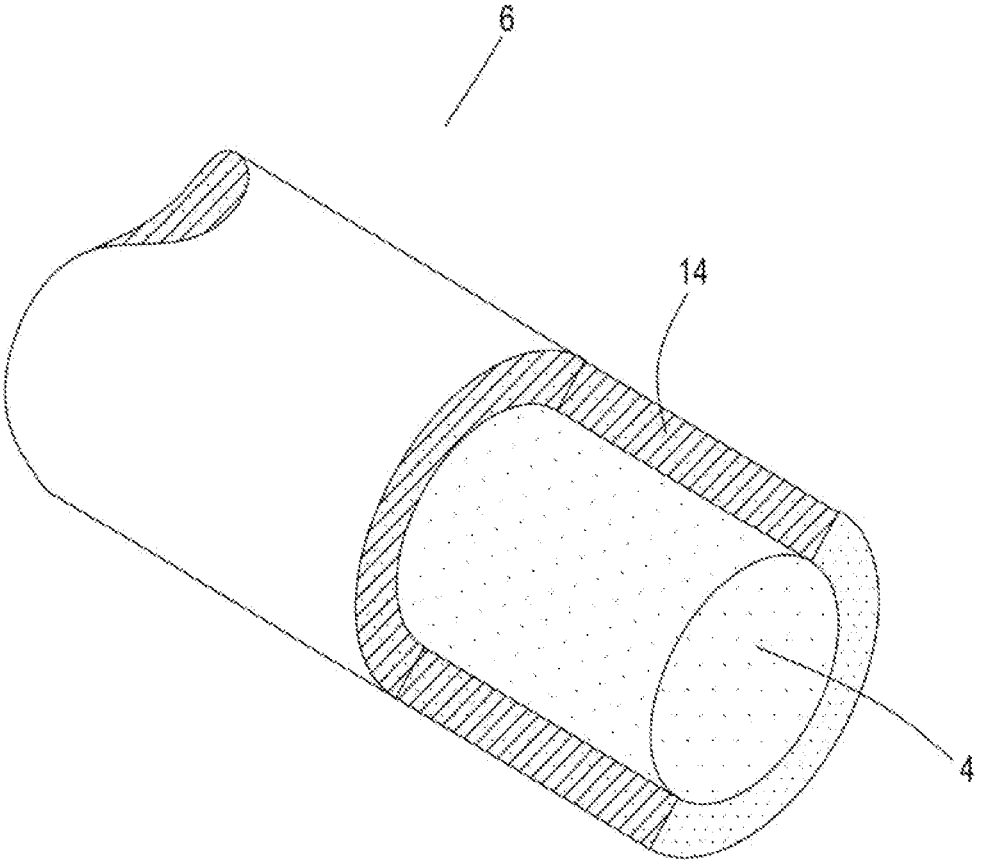
FIG. 6 is a three-dimensional schematic cross-sectional view of a deodorant and antibacterial nano copper fiber yarn according to an embodiment of this application.

Further, the mixed material 2 is delivered to a spinning machine C, and hot-melt spinning is performed on the mixed material 2 by using the spinning machine C, so as to obtain a yarn 4 from an outlet of the spinning machine C to form a primary thread. The thermoplastic polyurethane colloidal particles 14 are hot melted by the spinning machine C, and then may be further wrapped around a peripheral side of the primary thread at the outlet of the spinning machine C (as shown in FIG. 6), so as to form a first-stage thread 5.

Further, the first-stage thread 5 is delivered to a cooling tank D for forced cooling, which is first cooling, so as to shape a surface of the first-stage thread 5.

Further, the first-stage thread 5 after the first cooling is delivered to a tensile device E for stretching and extending the cooled first-stage thread 5, so as to control a thread diameter to be proper.

In an embodiment, the tensile device E includes a plurality of roller sets arranged in sequence, and the first-stage thread 5 is wound around the roller sets for stretching, so as to control the thread diameter.

Further, second cooling such as natural air cooling is performed on the first-stage thread 5. By means of the cooling, an inside of the first-stage thread 5 can be shaped to form a second-stage thread 6.

Further, the second-stage thread 6 is collected. For example, the second-stage thread 6 may be wound into a roll shape by winding the yarns, so as to form a deodorant and antibacterial nano copper fiber yarn product.

Further, the first fiber yarn slurry 111 may be one from a group consisting of a cotton fiber, a polyester fiber, a viscose fiber, and a Modal fiber, such as a single fiber or a combination of any of the foregoing fibers.

As shown in FIG. 6, the deodorant and antibacterial nano copper fiber yarn in this embodiment is the second-stage thread 6 manufactured by using the manufacturing method in the foregoing embodiments. An average particle size of the first metal nanoparticles is 1 nanometer to 100 nanometers. In addition, a content of the first metal nanoparticles included in the nano copper fiber yarn in the second-stage thread 6 is 10 micrograms to 100 micrograms per square centimeter of a fiber surface.

Figure 3:
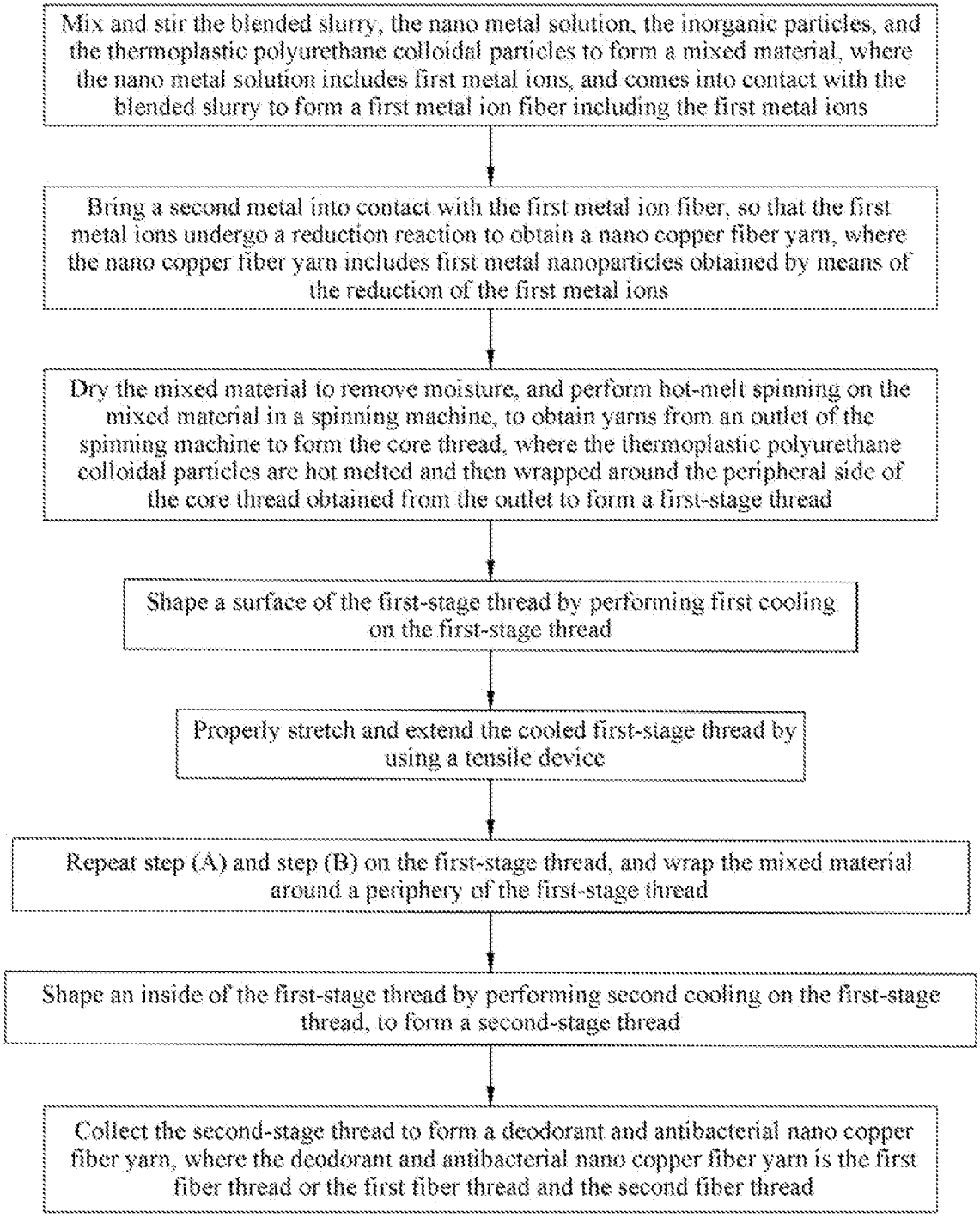
FIG. 3 is a flowchart of steps of a method for forming a core-spun yarn according to an embodiment of this application.

As shown in FIG. 3, a method for forming the core-spun yarn in this embodiment includes the following steps:

(A): mixing and stirring the blended slurry, the nano metal solution, the inorganic particles, and the thermoplastic polyurethane colloidal particles to form a mixed material, where the nano metal solution includes first metal ions and comes into contact with the blended slurry to form a first metal ion fiber including the first metal ions;

(B): bringing a second metal into contact with the first metal ion fiber, so that the first metal ions undergo a reduction reaction to obtain a nano copper fiber yarn, where the nano copper fiber yarn includes first metal nanoparticles obtained by means of the reduction of the first metal ions;

(C): drying the mixed material to remove moisture, and performing hot-melt spinning on the mixed material in a spinning machine, to obtain yarns from an outlet of the spinning machine to form the core thread, where the thermoplastic polyurethane colloidal particles are hot melted and then wrapped around the peripheral side of the core thread obtained from the outlet to form a first-stage thread;

(D): shaping a surface of the first-stage thread by performing first cooling on the first-stage thread;

(E): properly stretching and extending the cooled first-stage thread by using a tensile device;

(F): repeating step (A) and step (B) on the first-stage thread, and wrapping the mixed material around a periphery of the first-stage thread;

(G): shaping an inside of the first-stage thread by performing second cooling on the first-stage thread, to form a second-stage thread; and (H): collecting the second-stage thread to form a deodorant and antibacterial nano copper fiber yarn, wherein the deodorant and antibacterial nano copper fiber yarn is the first fiber thread or the first fiber thread and the second fiber thread.

In an embodiment, the first cooling in step D means that the first-stage thread continuously passes through a cooling tank over a period of time, and the second cooling in step G is natural air cooling.

In an embodiment, a standard reduction potential of the first metal ions is greater than a standard reduction potential of the second metal in an ionic state, and a standard reduction potential difference of the first metal ions is 0.4-4 volts greater than a standard reduction potential difference of the second metal in the ionic state.

In an embodiment, a temperature for drying in step C is controlled between 100° C. and 150° C.

In an embodiment, in step E, the tensile device includes a plurality of roller sets arranged in sequence to stretch the first-stage thread.

Figure 4:
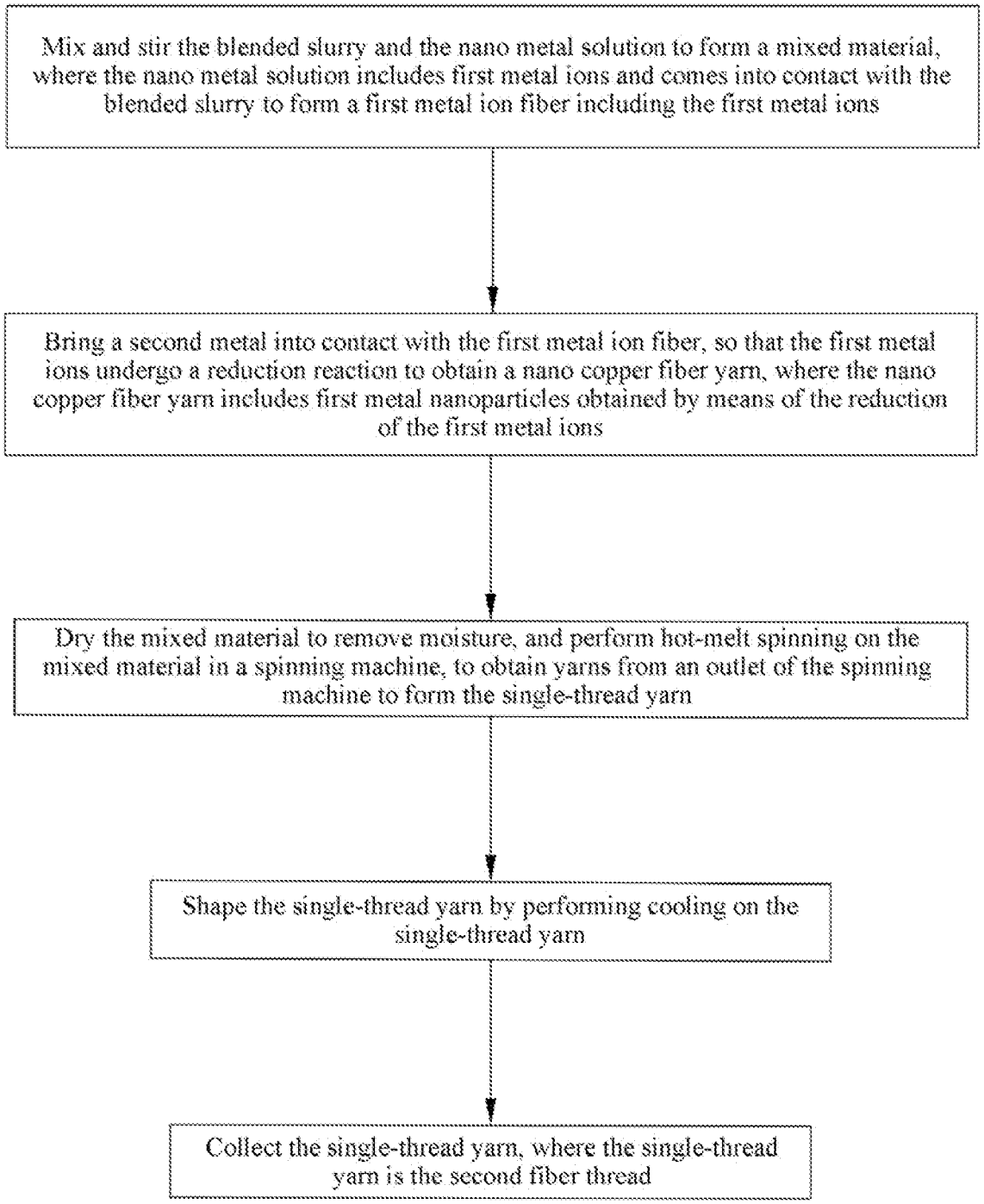
FIG. 4 is a flowchart of steps of a method for forming a single-thread yarn according to an embodiment of this application.

As shown in FIG. 4, a method for forming the single-thread yarn in this embodiment includes the following steps:

(A): mixing and stirring the blended slurry and the nano metal solution to form a mixed material, where the nano metal solution includes first metal ions and comes into contact with the blended slurry to form a first metal ion fiber including the first metal ions;

(B): bringing a second metal into contact with the first metal ion fiber, so that the first metal ions undergo a reduction reaction to obtain a nano copper fiber yarn, where the nano copper fiber yarn includes first metal nanoparticles obtained by means of the reduction of the first metal ions;

(C): drying the mixed material to remove moisture, and performing hot-melt spinning on the mixed material in a spinning machine, to obtain yarns from an outlet of the spinning machine to form the single-thread yarn;

(D): shaping the single-thread yarn by performing cooling on the single-thread yarn; and (E): collecting the single-thread yarn, where the single-thread yarn is the second fiber thread.

In an embodiment, the cooling in step D means that the single-thread yarn continuously passes through a cooling tank over a period of time.

In an embodiment, a standard reduction potential of the first metal ions is greater than a standard reduction potential of the second metal in an ionic state, and a standard reduction potential difference of the first metal ions is 0.4-4 volts greater than a standard reduction potential difference of the second metal in the ionic state.

In an embodiment, a temperature for drying in step C is controlled between 100° C. and 150° C.

By means of the method for manufacturing a deodorant and antibacterial protective cloth in the embodiments of this application, a deodorant and antibacterial protective cloth can be manufactured.

According to the above, a nanoscale fiber thread may be obtained by simply performing the process of this application at a room temperature without requiring expensive environment control devices. Therefore, this application has low costs, and can reduce energy consumption and high thermal pollution. The obtained first fiber thread and second fiber thread are intersected and laminated to form a plurality of bonding layers, so as to form the deodorant and antibacterial protective cloth. By means of the laminated arrangement, flexibility of an original fiber thread is maintained, the protective cloth has a very high strength, which is unlikely to be pierced, so that a protection factor is increased, and the laminated arrangement enables desirable breathability for the protective cloth, so that the protective cloth has a deodorant effect. Since the protective cloth is made of the fiber threads, and the fiber threads have strong antibacterial properties, the protective cloth also has a desirable antibacterial effect.

The foregoing embodiments are merely intended for describing the technical solutions of this application, but not for limiting this application. Although this application is described in detail with reference to the foregoing embodiments, a person of ordinary skill in the art is to understand that modifications may still be made to the technical solutions described in the foregoing embodiments or equivalent replacements may be made to some technical features thereof, as long as such modifications or replacements do not cause the essence of corresponding technical solutions to depart from the spirit and scope of the technical solutions of the embodiments of this application.

What is claimed is:

1. A method for manufacturing a deodorant and antibacterial protective cloth, comprising the following steps:

providing a first fiber thread and a second fiber thread, wherein the first fiber thread is a core-spun yarn formed by a blended slurry, a nano metal solution, a plurality of inorganic particles, and a plurality of thermoplastic polyurethane colloidal particles, the thermoplastic polyurethane colloidal particles are hot melted and then wrapped around a peripheral side of a core thread of the core-spun yarn for isolation from an outer wrapping layer of the core-spun yarn, and the second fiber thread is the same as the first fiber thread or is a single-thread yarn formed by the blended slurry and the nano metal solution; and intersecting and laminating the first fiber thread and the second fiber thread to form a plurality of bonding layers, wherein bonding arrangement angles in the layers comprise at least one of the following:

arrangement angles of the first fiber thread in a first layer, a third layer, and a fifth layer being successively 0°, 225°, and 135°, and arrangement angles of the second fiber thread in a second layer, a fourth layer, and a sixth layer being successively 90°, 315°, and 225°;

arrangement angles of the first fiber thread in the first layer, the third layer, and the fifth layer being successively 0°, 210°, and 150°, and arrangement angles of the second fiber thread in the second layer, the fourth layer, and the sixth layer being successively 90°, 300°, and 240°; and arrangement angles of the first fiber thread in the first layer, the third layer, and the fifth layer being successively 0°, 240°, and 120°, and arrangement angles of the second fiber thread in the second layer, the fourth layer, and the sixth layer being successively 90°, 330°, and 210°.

2. The method of claim 1, Wherein a method for forming the core-spun yarn comprises the following steps:

(A): mixing, and stirring the blended slurry, the nano metal solution, the inorganic particles, and the thermoplastic polyurethane colloidal particles to form a mixed material, wherein the nano metal solution comprises first metal ions and comes into contact with the blended shiny to form a first metal ion fiber comprising the first metal ions;

(B): bringing a second metal into contact with the first metal ion fiber, so that the first metal ions undergo a reduction reaction to obtain a nano copper fiber yarn, wherein the nano copper fiber yarn comprises first metal nanoparticles obtained by means of the reduction of the first metal ions;

(C): drying the mixed material to remove moisture, and performing hot-melt spinning on the mixed material in a spinning machine, to obtain yarns from an outlet of the spinning machine to form the core thread, Wherein the thermoplastic polyurethane colloidal particles are hot melted and then wrapped around the peripheral side of the core thread obtained from the outlet to form a first-stage thread;

(D): shaping a surface of the first-stage thread by performing first cooling on the first-stage thread;

(E): extending the cooled first-stage thread by using a tensile device;

(F): repeating step (A) and step (B) on the first-stage thread, and wrapping the mixed material around a periphery of the first-stage thread;

(G): shaping an inside of the first-stage thread by performing second cooling on the first-stage thread, to form a second-stage thread; and (H): collecting the second-stage thread to form a deodorant and antibacterial nano copper fiber yarn, wherein the deodorant and antibacterial nano copper fiber yarn is the first fiber thread or the first fiber thread and the second fiber thread.

3. The method of claim 2, wherein a standard reduction potential of the first metal ions is greater than a standard reduction potential of the second metal in an ionic state, and a standard reduction potential difference of the first metal ions is 0.4-4 volts greater than a standard reduction potential difference of the second metal in the ionic state.

4. The method of claim 2, wherein a temperature for drying in step C is controlled between 100° C. and 150° C.

5. The method of claim 2, wherein the first cooling in step D means that the first-stage thread continuously passes through a cooling, tank over a period of time, and the second cooling in step G is natural air cooling.

6. The method for manufacturing the deodorant and antibacterial protective cloth according, to claim 2, wherein in step E, the tensile device comprises a plurality of roller sets arranged in sequence to stretch the first-stage thread.

7. The method of claim 1, wherein a method for forming the single-thread yarn comprises the following steps:

(A): mixing and stirring, the blended slurry and the nano metal solution to form a mixed material, wherein the nano metal solution comprises first metal ions and comes into contact with the blended slurry to form a first metal ion fiber comprising the first metal ions;

(B): bringing a second metal into contact with the first metal ion fiber, so that the first metal ions undergo a reduction reaction to obtain a nano copper fiber yarn, wherein the nano copper fiber yarn comprises first metal nanoparticles obtained by means of the reduction of the first metal ions;

(C): drying the mixed material to remove moisture, and performing hot-melt spiraling on the mixed material in a spinning machine, to obtain yarns from an outlet of the spinning machine to form the single-thread yarn;

(D): shaping the single-thread yarn by performing cooling on the single-thread yarn; and (E): collecting the single-thread yarn, wherein the single-thread yarn is the second fiber thread.

8. The method of claim 7, wherein the first metal ions are copper ions, and the second metal comprises magnesium, aluminum, manganese, titanium, zinc, iron, nickel, tin, copper, or silver.

9. The method of claim 7, wherein a standard reduction potential of the first metal ions is greater than a standard reduction potential of the second metal in an ionic state, and a standard reduction potential difference of the first metal ions is 0.4-4 volts greater than a standard reduction potential difference of the second metal in the ionic state.

10. The method of claim 7, wherein a temperature for drying in step C is controlled between 100° C. and 150° C.

11. The method of claim 7, wherein the cooling in step D means that the single-thread yarn continuously passes through a cooling tank over a period of time.

12. The method of claim 1, wherein the blended slurry comprises a first fiber yarn slurry and a second fiber yarn shiny, the first fiber yarn slurry is selected from a cotton fiber, a polyester fiber, a viscose fiber and a Modal fiber, an ultra-high-molecular-weight polyethylene fiber, and a polypropylene fiber, and the second fiber yarn shiny is selected from an aromatic polyamide fiber, a polyamide fiber, a polyethylene terephthalate fiber, a polyethylene naphthalate fiber, an extended-chain polyvinyl alcohol fiber, an extended-chain polyacrylonitrile fiber; a polybenzoxazole fiber, a polybenzothiazole fiber, a liquid-crystal copolyester fiber, a rigid-rod fiber, a glass fiber, and a structural glass fiber.

13. The method of claim 1, wherein the thermoplastic polyurethane colloidal particles comprise thermoplastic polyurethane, polyethylene, polypropylene, polyethylene terephthalate, polyamide, polybutylene terephthalate, an ethylene-vinyl acetate copolymer or nylon, and copper modified polyacrylonitrile.

14. The method of claim 1, wherein the plurality of inorganic particles is rare earth or mineral particle powder.

15. A deodorant and antibacterial protective cloth, manufactured by using the method of claim 1.

* * * * *